US012022955B2

(12) United States Patent
Van Doornewaard

(10) Patent No.: US 12,022,955 B2
(45) Date of Patent: Jul. 2, 2024

(54) ENVIRONMENTALLY CONDITIONED FURNITURE, AND ASSOCIATED SYSTEMS AND METHODS

(71) Applicant: Pure-Development 1 B.V., Baarn (NL)

(72) Inventor: Barry Van Doornewaard, Baarn (NL)

(73) Assignee: PURE-DEVELOPMENT 1 B.V. (NL)

( * ) Notice: Subject to any disclaimer, the term of this patent is extended or adjusted under 35 U.S.C. 154(b) by 35 days.

(21) Appl. No.: 17/198,126

(22) Filed: Mar. 10, 2021

(65) Prior Publication Data

US 2022/0287472 A1 Sep. 15, 2022

(51) Int. Cl.
*A47C 21/04* (2006.01)
*A47C 19/02* (2006.01)

(52) U.S. Cl.
CPC ..... *A47C 21/044* (2013.01); *A47C 19/021* (2013.01)

(58) Field of Classification Search
CPC ..... A47C 21/04; A47C 21/042; A47C 21/044; A47C 21/048; A47C 19/021
See application file for complete search history.

(56) References Cited

U.S. PATENT DOCUMENTS 3,164,110 A 1/1965 Bofinger
3,266,064 A 8/1966 Figman
3,513,490 A * 5/1970 Wagner ..... A47C 19/024 5/8
3,736,604 A 6/1973 Carson
3,746,835 A * 7/1973 Yu ..... A47C 21/048 219/217
4,186,452 A * 2/1980 Underwood ..... A47C 17/86 5/493
4,939,804 A * 7/1990 Grant ..... A47C 21/044 5/423
5,408,711 A 4/1995 McClelland
5,678,352 A 10/1997 Leitner et al.
5,887,304 A * 3/1999 von der Heyde .... A47D 15/001 5/724

(Continued)

FOREIGN PATENT DOCUMENTS

CA 2482406 C 9/2003
CN 2191584 Y 3/1995

(Continued)

OTHER PUBLICATIONS

Freshbed, "FreshBed iFo 3D-Animation," (https://www.youtube.com/watch?v=j9J3elNZuu0), Nov. 18, 2020.

(Continued)

*Primary Examiner* — Justin C Mikowski
*Assistant Examiner* — George Sun
(74) *Attorney, Agent, or Firm* — PERKINS COIE LLP

(57) ABSTRACT

Environmentally conditioned furniture, such as a bed are disclosed herein. A representative bed includes a bed frame for supporting an air-permeable mattress or cushion, the bed frame comprising a shell frame having at least one air inlet with a total inlet flow-through area, and at least one air outlet, in fluid communication with the air inlet, and having a total outlet flow-through area. The bed frame is arranged for accommodating an air distribution unit in fluid communication with the air outlet, and in a top plan view, at most 30% of the inlet total flow-through area overlaps with the outlet total flow-through area.

21 Claims, 7 Drawing Sheets

(56) References Cited

U.S. PATENT DOCUMENTS

| | | | | |
|---|---|---|---|---|
| 6,584,627 | B1 * | 7/2003 | Yang | A47C 23/26 5/174 |
| 7,178,183 | B2 * | 2/2007 | Cho | A47C 31/004 5/948 |
| 7,837,932 | B2 | 11/2010 | Hedman | |
| 8,272,143 | B1 | 9/2012 | Hedman | |
| 9,131,675 | B2 | 9/2015 | Smith | |
| 9,756,952 | B2 | 9/2017 | Alletto, Jr. et al. | |
| D819,357 | S | 6/2018 | van Doornewaard | |
| 10,034,550 | B2 | 7/2018 | Rydsund | |
| 2003/0019044 | A1 | 1/2003 | Larsson et al. | |
| 2003/0070235 | A1 | 4/2003 | Suzuki et al. | |
| 2003/0145380 | A1 | 8/2003 | Schmid | |
| 2004/0253920 | A1 * | 12/2004 | Schoettle | F24F 7/04 454/907 |
| 2005/0229319 | A1 | 10/2005 | Cho | |
| 2006/0053558 | A1 | 3/2006 | Ye | |
| 2006/0101577 | A1 | 5/2006 | Lussier | |
| 2006/0174410 | A1 | 8/2006 | Mastandrea, Jr. | |
| 2007/0136952 | A1 | 6/2007 | Sargent | |
| 2008/0313810 | A1 * | 12/2008 | Cretsinger | A47C 23/002 5/503.1 |
| 2009/0064411 | A1 | 3/2009 | Marquette et al. | |
| 2010/0005588 | A1 * | 1/2010 | Christopher | A47C 31/123 5/423 |
| 2010/0011502 | A1 | 1/2010 | Brykalski et al. | |
| 2010/0115696 | A1 * | 5/2010 | Felix, Jr. | A47C 19/024 5/201 |
| 2010/0319125 | A1 | 12/2010 | Ko | |
| 2011/0296610 | A1 * | 12/2011 | Moon | A47C 19/025 5/308 |
| 2012/0186138 | A1 | 7/2012 | Bell et al. | |
| 2012/0233907 | A1 | 9/2012 | Pattison et al. | |
| 2012/0240451 | A1 | 9/2012 | Ricks | |
| 2012/0285944 | A1 | 11/2012 | Bermudez | |
| 2013/0061395 | A1 * | 3/2013 | Karl | A47C 31/02 5/503.1 |
| 2013/0263496 | A1 | 10/2013 | Maloney et al. | |
| 2013/0276358 | A1 | 10/2013 | Knote et al. | |
| 2014/0013653 | A1 | 1/2014 | Lander | |
| 2014/0109314 | A1 * | 4/2014 | Boersma | A47C 21/048 5/423 |
| 2014/0137569 | A1 | 5/2014 | Parish et al. | |
| 2014/0173970 | A1 | 6/2014 | Martin | |
| 2014/0201909 | A1 | 7/2014 | Weyl | |
| 2014/0271349 | A1 | 9/2014 | Gowda et al. | |
| 2015/0208814 | A1 * | 7/2015 | Alletto, Jr. | A61G 7/05784 5/423 |
| 2016/0136385 | A1 | 5/2016 | Scorcioni | |
| 2017/0202365 | A1 * | 7/2017 | Polevoy | A47C 19/025 |
| 2017/0296412 | A1 * | 10/2017 | Hung | A47C 21/044 |
| 2017/0348182 | A1 | 12/2017 | Yoo et al. | |
| 2018/0110341 | A1 | 4/2018 | Reynolds | |
| 2018/0160819 | A1 | 6/2018 | Rutledge | |
| 2018/0271300 | A1 | 9/2018 | Wang | |
| 2019/0105458 | A1 | 4/2019 | Hammes et al. | |
| 2019/0126000 | A1 | 5/2019 | Main et al. | |
| 2019/0320808 | A1 * | 10/2019 | Chapin | A47C 21/044 |
| 2019/0380501 | A1 * | 12/2019 | Reynolds | A47C 21/044 |
| 2020/0170418 | A1 * | 6/2020 | Oh | A47C 31/007 |
| 2020/0198509 | A1 * | 6/2020 | Conze | B60N 2/26 |
| 2020/0237106 | A1 * | 7/2020 | Alletto, Jr. | A47C 27/007 |
| 2020/0397148 | A1 | 12/2020 | Elliott et al. | |
| 2021/0204709 | A1 | 7/2021 | Grabinger et al. | |
| 2021/0204720 | A1 * | 7/2021 | Karschnik | G16H 40/63 |
| 2021/0227987 | A1 * | 7/2021 | Alletto, Jr. | A47C 21/044 |
| 2021/0307524 | A1 | 10/2021 | Nishida et al. | |
| 2021/0307525 | A1 | 10/2021 | Kim et al. | |
| 2021/0307529 | A1 | 10/2021 | Kim et al. | |
| 2021/0307531 | A1 * | 10/2021 | Lee | A61G 7/05 |

FOREIGN PATENT DOCUMENTS

| | | | | |
|---|---|---|---|---|
| CN | 204105404 | U | 1/2015 | |
| DE | 20113292 | U1 | 9/2002 | |
| DE | 102017003332 | A1 | 10/2018 | |
| EP | 1804616 | B1 | 2/2012 | |
| EP | 0957727 | B1 | 3/2022 | |
| GB | 379439 | A | 9/1932 | |
| GB | 2334889 | A | 9/1999 | |
| JP | S5670719 | A | 6/1981 | |
| JP | H04108411 | A | 4/1992 | |
| JP | H04108498 | A | 4/1992 | |
| JP | H09140506 | A | 6/1997 | |
| KR | 20140071931 | A | 6/2014 | |
| KR | 20180053024 | A | 5/2018 | |
| KR | 20200092139 | A | 8/2020 | |
| KR | 20200002751 | U | 12/2020 | |
| WO | 1996039905 | A1 | 12/1996 | |
| WO | 2005120295 | A1 | 12/2005 | |
| WO | WO-2005120295 | A1 * | 12/2005 | A47C 21/044 |
| WO | 2013017869 | A1 | 2/2013 | |

OTHER PUBLICATIONS

Partial search report issued for corresponding NL Application No. 2027737, Applicant: Pure-Development 1 B.V., Date of Mailing: Dec. 8, 2021, 9 pages.

International Search Report and Written Opinion mailed Apr. 22, 2022 in International Application No. PCT/NL2022/050132, 15 pages.

* cited by examiner

ENVIRONMENTALLY CONDITIONED FURNITURE, AND ASSOCIATED SYSTEMS AND METHODS

TECHNICAL FIELD

The present technology is directed generally to environmentally controlled or conditioned furniture, including beds and seats and, in particular, to an air-handling unit for such furniture.

BACKGROUND

EP1804616A1 discloses environmentally conditioned furniture, such as a bed, with a permeable mattress or cushion set upon a plenum chamber base, with a ventilator fan, a distribution duct and heating unit, co-operatively disposed to intake ambient air and expel conditioned chamber air through the mattress, with the conditioned air having a controlled temperature and/or relative humidity, for the comfort and/or respiratory benefit of a bed occupant.

SUMMARY

Environmentally conditioned furniture allows close control of the skin temperature of a person, for example in or on a bed or another piece of furniture arranged for accommodating a sleeping or resting person. Skin temperature and variation of skin temperature are important factors in improving sleep quality.

It has been observed that environmentally conditioned furniture may generate undesired noise, compared to conventional furniture. It is therefore desirable to reduce the generated noise as much as possible.

A first aspect of the present technology includes environmentally conditioned furniture, such as a bed, comprising a bed frame for supporting an upholstered item such as an air-permeable mattress or cushion, a shell frame having an air inlet with an inlet flow-through area, and an air outlet with an outlet flow-through area. The air outlet is in fluid communication with the air inlet, and the bed frame is arranged for accommodating an air distribution unit in fluid communication with the air outlet. At most, 30% of the inlet flow-through area (when seen in plan view) overlaps with the outlet flow-through area.

In further embodiments, at most 20% or at most 10% of the inlet flow-through area overlaps with the outlet flow-through area.

Sound may be generated at different locations in and around the furniture, and may emanate from different sources. For example, moving components such as a fan may generate sound. Also, air flowing through a constrained flow-through area may generate sound. The level of sound may depend on the flow-through area characteristics, and/or the velocity of the airflow. Typically, a higher velocity of airflow results in a higher sound level.

The inlet flow-through area of the air inlet can be measured at the location where air first enters the air inlet. The outlet flow-through area of the air outlet can be measured at the location where air first enters the air outlet.

As an option, in the top plan view, no portion of the inlet flow-through area overlaps with the outlet flow-through area. As such, the entire airflow path between the inlet flow-through area and the outlet flow-through area has at least a partial non-vertical component (e.g., a circuitous flow path between the inlet flow-through area and the outlet flow-through area positioned above).

As a further option, no straight line can be drawn through the inlet flow-through area and the outlet flow-through area without this straight line intersecting an internal element of the furniture. Accordingly, no straight path for sound waves originating at the inlet flow-through area is provided to the outlet flow-through area, and vice versa. That is, no straight path for sound waves originating at the outlet flow-through area is provided to the inlet flow-through area. This option may be a feature of any embodiment of the furniture, regardless of whether or not the inlet flow-through area overlaps with the outlet flow-through area in a top plan view.

In another embodiment, no straight airflow path is provided between the inlet flow-through area and the outlet flow-through area by virtue of their being offset from each other, e.g., in a generally horizontal direction. Additionally or alternatively, one or more objects (e.g., obstructions, diverters, and/or guides) may be present between the inlet flow-through area and the outlet flow-through area to prevent a straight airflow path.

The inlet flow-through area may be oriented generally parallel to the outlet flow-through area, and the inlet flow-through area and the outlet flow-through area may as such both be oriented for example generally horizontally or vertically in use.

In particular, when the shell frame has a bottom section and a top section opposite the bottom section, the air inlet may be positioned to extend through the bottom section, and the air outlet may be positioned to extend through the top section. In use, at least part of the bottom section may be oriented generally horizontally, and the top section may also be oriented generally horizontally. Generally, "horizontally" corresponds to the typical orientation of a bed mattress, when in use. Any part of the shell frame may be substantially thin-walled.

As an option, which may be applied to any embodiment of the furniture, a perimeter bounding the flow-through area of at least one air inlet may have a concave shape.

A representative environmentally conditioned piece of furniture, such as a bed, can include a bed frame for supporting an air-permeable mattress or cushion. The bed frame has a shell frame defining a hollow chamber therein, and the shell frame includes an air inlet with an inlet flow-through area, and an air outlet with an outlet flow-through area. The flow-through area of the air inlet is bounded by a concave perimeter. The inlet flow-through area and the outlet flow-through area may have any orientation relative to each other. Different options disclosed in this description may be readily combined with this particular embodiment of the furniture.

In representative embodiments, the concave perimeter of a flow-through area may be achieved via at least part of the air inlet being "toothed," scalloped, and/or otherwise having a "ragged" or non-straight edge, or being rounded inward, and/or any combination thereof. In general, a concave perimeter for a flow-through area may result in less sound being generated by an air flow through the flow-through area than with a convex flow-through area.

A concave perimeter may be shaped as any concave polygon. A concave polygon may be defined by the property that at least one line containing interior points of the concave polygon intersects its boundary at more than two points. Some diagonals of a concave polygon may lie partly or wholly outside the polygon. Furthermore, some sidelines of a concave polygon may fail to divide the plane into two half-planes one of which entirely contains the polygon.

By virtue of a concave a perimeter bounding the flow-through area, sound generated by air flowing through the flow-through area may be reduced. It will be appreciated that any shape disclosed in conjunction with an inlet flow-through area may readily be applied to any outlet flow-through area.

As a particular option, the flow-through area with the concave perimeter may include at least one tooth protruding inwardly from a periphery of the inlet flow-through area. As a further option, the entire polygon bounding the concave flow-through area may be toothed with teeth protruding inwardly from a periphery of the inlet flow-through area.

At least part of the air inlet may be surrounded by a raised wall protruding into the hollow chamber of the shell frame. In particular, an entire air inlet may be surrounded by the raised wall. This may allow a particular shell thickness to be obtained locally surrounding at least part of the air inlet without having to increase the shell thickness of the entire shell frame. A shape of a flow-through area through the raised wall may generally correspond to the shape, for example the concave shape, of the flow-through area of an air inlet surrounded by the raised wall. As such, a constant flow-through area may be provided for an airflow flowing through the air inlet.

At least part of the air inlet may be surrounded by sound-absorbing material positioned inside the shell frame. The sound-absorbing material may directly surround the air inlet, or may be located at a particular offset distance, for example to accommodate the optional raised wall.

A sound-absorbing material may include any material or combination of materials that are arranged to absorb at least part of the sound energy of a sound wave encountering the material, as opposed to reflecting all the sound energy. Examples of sound-absorbing materials include soft, pliable, and/or porous materials such as foams (e.g., open-cell foams), and cloth.

When at least part, or all of an air inlet is surrounded by a raised wall, sound-absorbing material may surround at least part, or all of the raised wall. As a particular option, the sound-absorbing material may protrude further into the hollow chamber of the shell frame than the raised wall. As such, sound generated by air flowing over the raised wall into the hollow chamber may encounter the sound-absorbing material and be at least partially absorbed.

The surface area of the inlet flow-through area of the air inlet may be larger than the surface area of the outlet flow-through area. For example, the inlet flow-through area of the air inlet may be 20% larger, 50% larger or 100% larger than the surface area of the outlet flow-through area.

The shell frame may be held by a support frame having one or more legs to support the shell frame at a distance from a floor surface on which the one or more legs are placed.

Embodiments of the furniture may include an air distribution unit having an air distribution unit housing with a distribution inlet and a distribution outlet, and a fan placed inside the air distribution unit housing. The fan generates an airflow through the air distribution unit housing from the distribution inlet to the distribution outlet, with the distribution inlet in fluid communication with the air outlet of the shell frame.

The distribution inlet may be positioned in an overlapping relationship with respect to the air outlet of the shell frame and/or the distribution inlet may be positioned below the air outlet of the shell frame. This may allow a compact construction of the furniture.

Where reference is made to "an" air inlet or "an" air outlet, embodiments can include than one air inlet and/or more than one air outlet. Where reference is made to a flow-through area, this may refer to the flow-through area of a single air inlet or air outlet, or to the combined flow-through area of the more than one air inlet and/or more than one air outlet.

BRIEF DESCRIPTION OF THE DRAWINGS

The present technology will further be elucidated on the basis of representative embodiments which are represented in the drawings. The representative embodiments are provided by way of non-limitative illustration. It is noted that the figures are only schematic representations of embodiments of the present technology that are given by way of non-limiting example.

In the drawings.

DETAILED DESCRIPTION

Figure 1A:
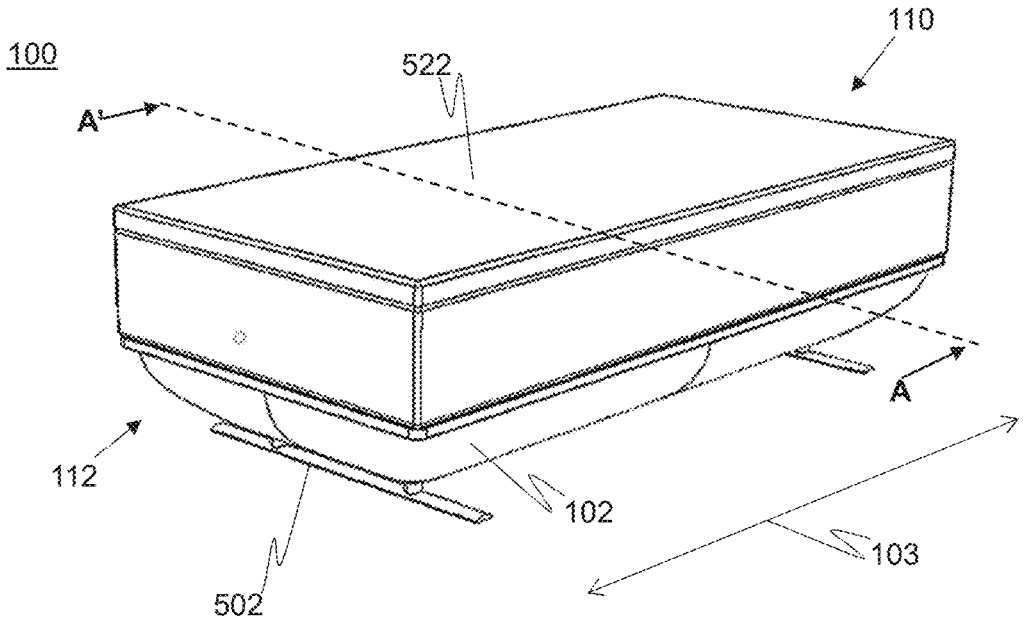
FIGS. 1A and FIG. 1B depict in a perspective view embodiments of a bed.
Figure 1B:
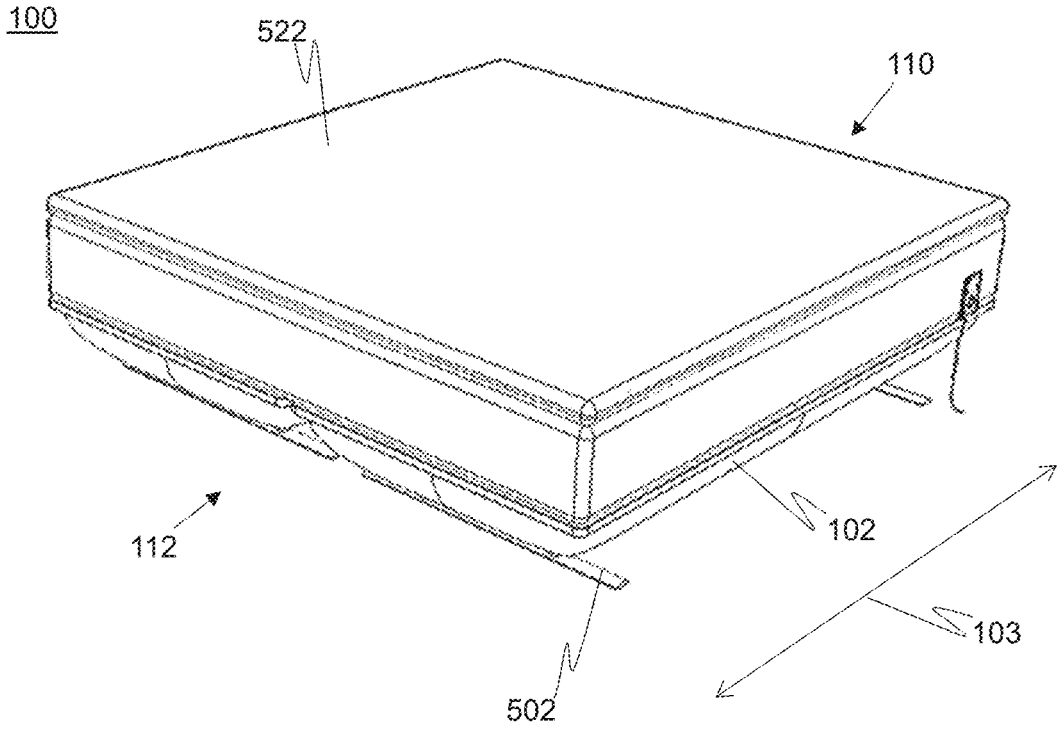

FIGS. 1A and 1B show in a perspective view a general overview of a bed 100 as an example of an environmentally-controlled piece of furniture. In particular, FIG. 1A depicts a single bed and FIG. 1B depicts a double bed.

The beds of FIGS. 1A and 1B comprise a bed frame 102. The bed frame 102 of a double bed may be formed by two bed frames of a single bed placed adjacent to each other. This may allow separate environmental control of for example two sides of the bed which are supported by separate bed frames. Alternatively, the bed frame of a double bed may be formed by one bed frame with a suitable size to accommodate a double bed mattress.

In general in the figures, double arrowed line 103 indicates a longitudinal axis 103 extending from the foot end 112 to head end 110 of the bed.

Figure 2A:
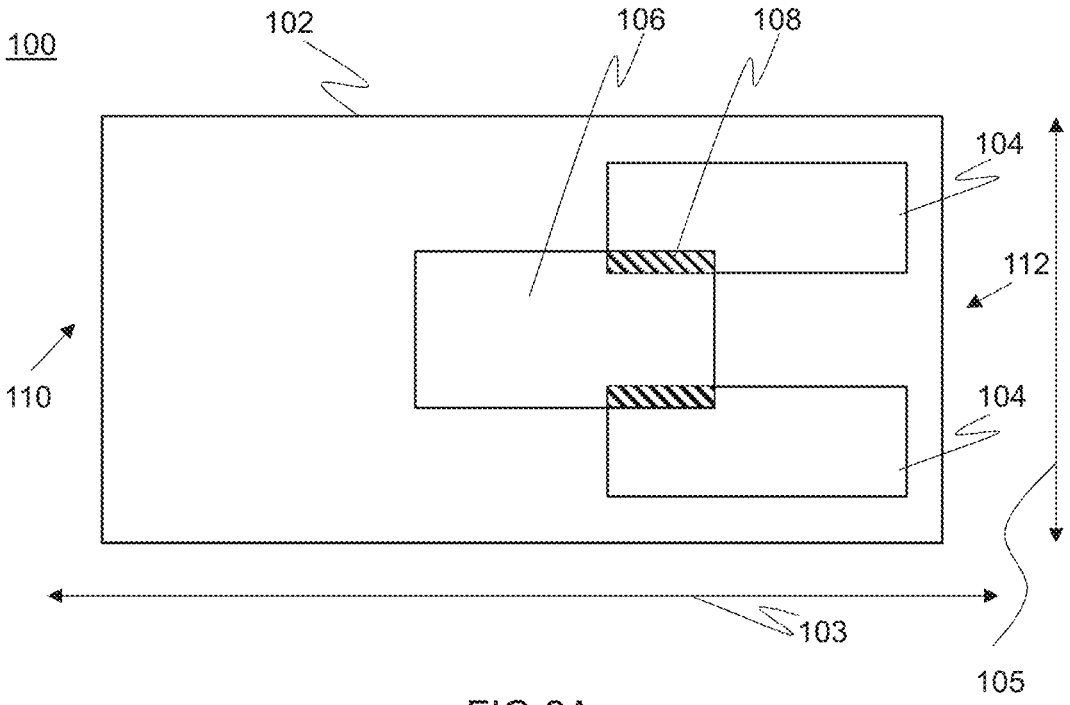
FIGS. 2A and FIG. 2B schematically depict a plan view of a representative bed as an example of an environmentally controlled piece of furniture.
Figure 2B:
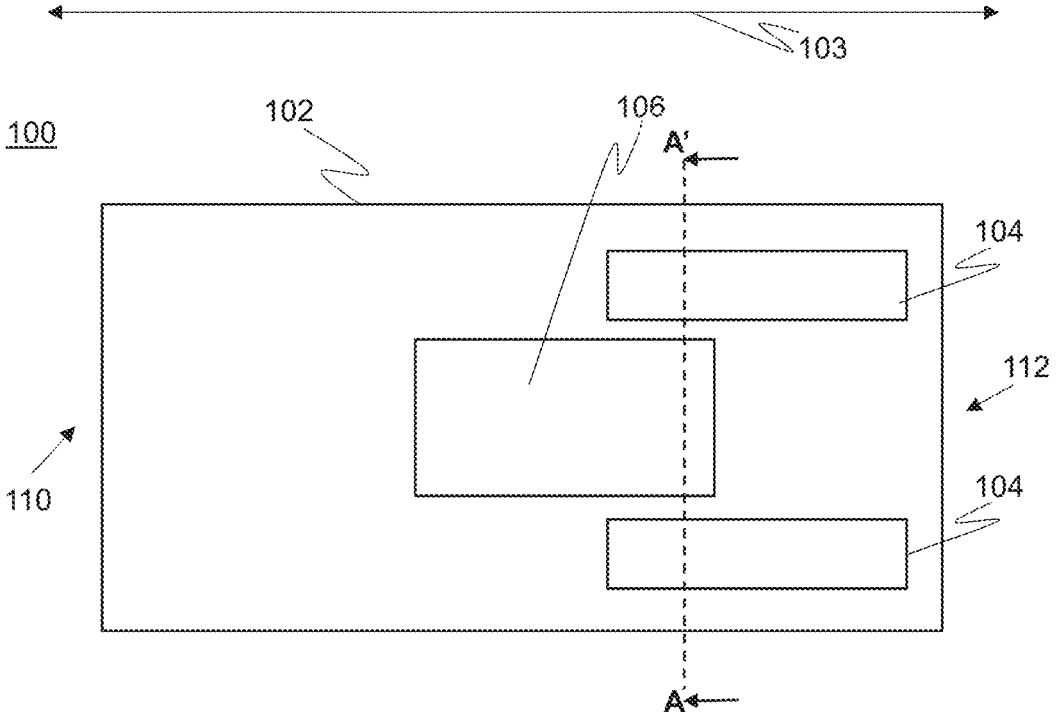
Figure 3A:
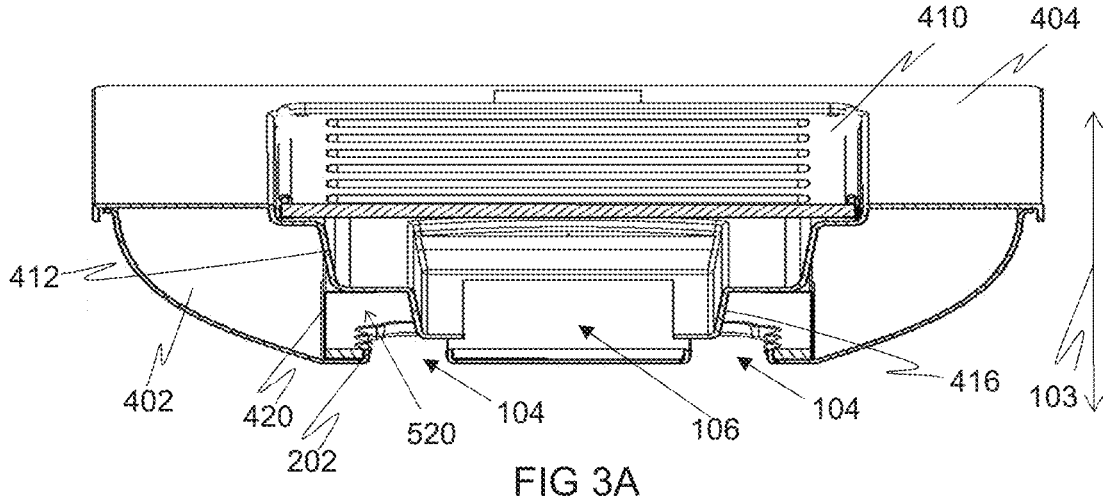
FIGS. 3A, 3B and 3C show cross-sectional views taken generally along line A-A' of FIG. 2B.
Figure 3B:
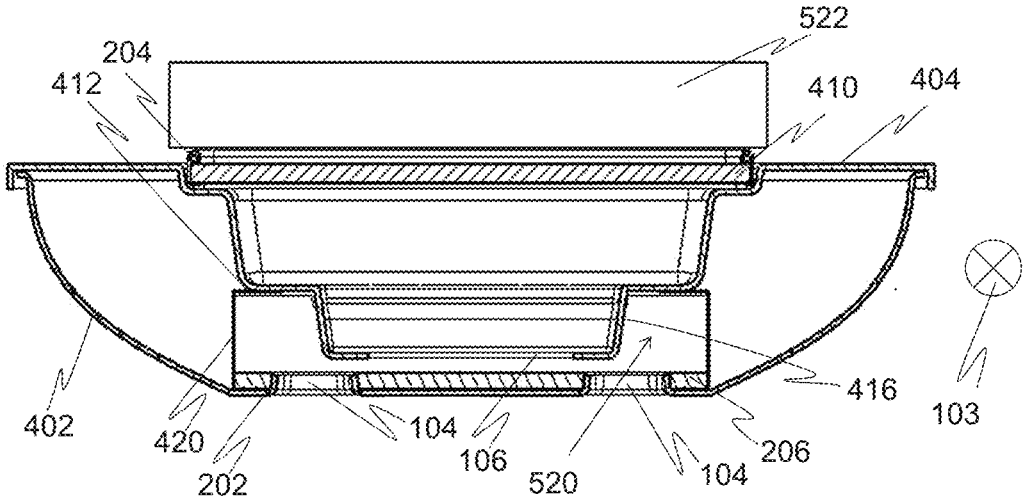
Figure 3C:
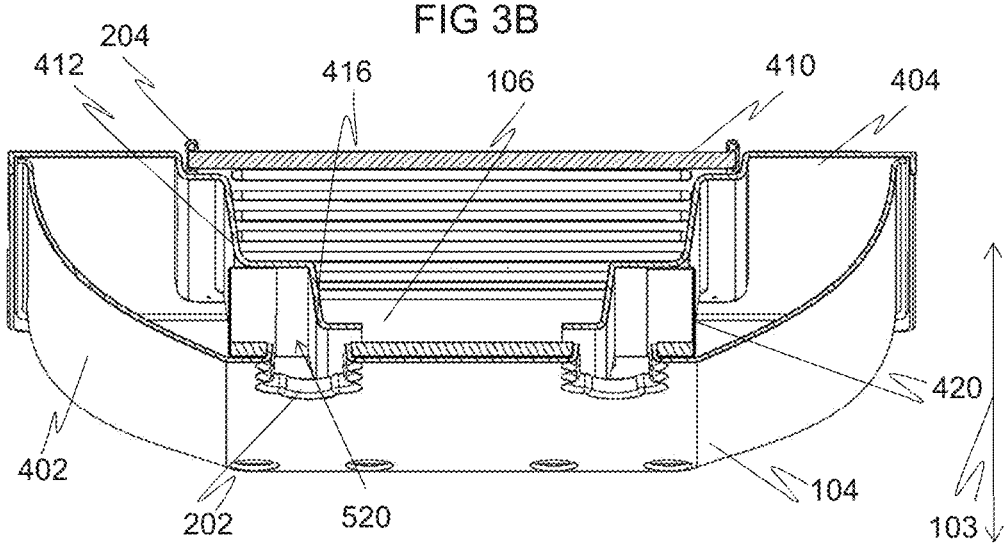

FIG. 2A and FIG. 2B are schematic plan views of a bed 100 as an example of an environmentally-controlled piece of furniture, which is shown in greater detail in FIGS. 3A, 3B and 3C. The bed 100 comprises a bed frame 102, which, for example, may be or include a shell frame. Provided in the shell frame are two air inlets 104 and one inner air inlet or air outlet 106. It will be appreciated that embodiments of the bed 100 may comprise any suitable number of air inlets and air outlets, for example only one air inlet and/or multiple air outlets.

The bed 100 may for example be a single or double bed. Other examples of suitable conditioned furniture are couches, chairs, convertible sofas, sleeper sofas, chaise lounges, or any other furniture comprising a mattress or cushion on which a person may sit and/or lie down.

In the top plan view of FIG. 2A, two overlapping parts of an air inlet surface of the air inlets 104 and an air outlet surface of the air outlet 106 are hatched. At most 30%, at most 20%, at most 10% or 0% of the air inlet surface overlaps with the outlet surface in the top plan view. For example, FIG. 2B depicts an embodiment of the bed 100 wherein, in the top plan view, none of the air inlet surfaces overlap with the outlet surface.

The bed 100 has a head end 110 and a foot end 112 opposite the head end 110. The air inlets 104 may be positioned closer to the foot end 112 than to the head end 110. In particular, the air inlets 104 may be provided in a foot end half of the bed 112. The air outlet 106 may also be positioned closer to the foot end 112 than to the head end 110.

As depicted in FIGS. 2A and 2B, the air inlets 104 may be offset relative to the air outlet 106 in a longitudinal or lengthwise direction (e.g., along a first or longitudinal axis 103 extending from the foot end 112 to head end 110), and/or in a lateral or widthwise direction (e.g., perpendicular to the longitudinal direction along a second or lateral axis 105).

FIGS. 3A, 3B and 3C show a cross-sectional view taken generally along line A-A' of in FIG. 2B at three different orientations. In the cross-sections, the two air inlets 104 are visible, as is the air outlet 106.

The air inlets 104 each include, along their respective perimeters, an optional raised wall 202 protruding from a bottom shell part 402 and into an inlet chamber 520. In the particular embodiment of FIGS. 3A, 3B and 3C, the inlet chamber 520 is bounded by part of the bottom shell part 402, part of the top shell part 404, the support frame 420, the one or more air inlets 104, and the air outlet 106. In a representative embodiment, the inlet chamber 520 may be bounded by part of a second recessed section 412 and part of a third recessed section 416, or by the third recessed section 416. The inlet chamber 520 may, in at least some embodiments, be further bounded by one or more separators or separation walls. The support frame and the recessed section are elaborated on later with reference to FIGS. 5A, 5B, and 5C.

It may be advantageous to limit the volume of the inlet chamber 520, to prevent or reduce the extent to which the inlet chamber 520 may form an echo chamber and/or a sound box and/or a resonance chamber. Furthermore, it may be advantageous that the inlet chamber 520 does not extend to a point located below, or near the head end 110 of the bed, to provide separation between the inlet chamber and the sleeper's ears.

FIG. 3B schematically shows an air-permeable mattress 522 placed on a slatted bed base 410. Optionally, a seal 204 may be positioned between the mattress 522 and the bed base 410 to prevent, or at least reduce air leakage between the mattress 522 and the bed base 410. The seal 204 may, for example, be a resilient seal arranged to deform elastically under the load of the mattress 522 and/or a person lying on the mattress 522. The seal 204 may be provided along the full perimeter of the bed base 410.

A sound-absorbing insert 206 can be positioned around or surrounding the raised wall 202 and (in at least some embodiments) covers the entire bottom of the inlet chamber 520. As an option shown in the figures, for example in FIGS. 3B and 5C, the insert 206 protrudes into the inlet chamber 520 further than does the raised wall 202. The raised wall 202 and the insert 206 are also depicted in FIG. 5C.

The insert 206 may, for example, be made from any of a variety of foams. In addition to, or in lieu of using an insert 206, at least part of the inner surface of the inlet chamber 520 may be clad and/or covered with sound-absorbing material.

The air inlets 104 and the air outlet 106 are shown in the embodiments of FIGS. 3A, 3B and 3C as being in fluid communication with each other via the inlet chamber 520. As an alternative to the inlet chamber 520, the air inlets 104 and the air outlet 106 may be in fluid communication via one or more air conduits and/or air ducts arranged to transport air therethrough. In such embodiments, at least part of an inner surface of the air conduit or duct may be clad with, covered by, and/or include sound-absorbing material.

Figure 4A:
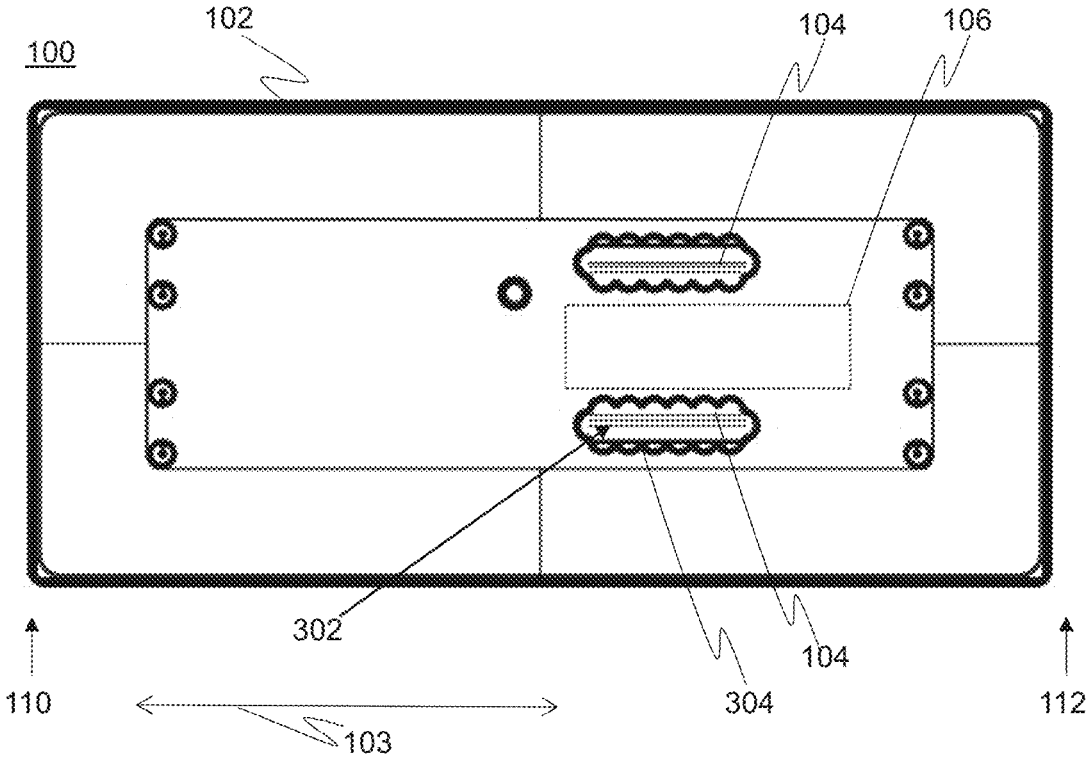
FIGS. 4A and 4B show the bottom of an embodiment of a bed in plan view (FIG. 4A) and a perspective view (FIG. 4B)
Figure 4B:
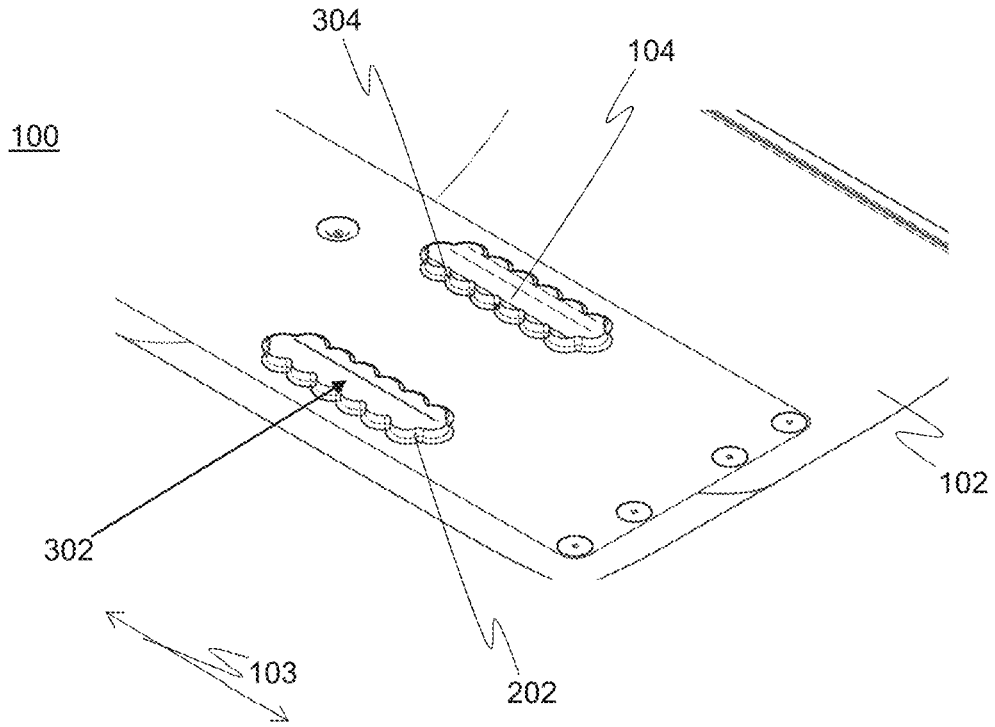

FIGS. 4A and 4B show the bottom of a representative bed 100, in a bottom plan view and a perspective view, respectively. In the bottom view, the air inlets 104 are visible. In FIG. 4A, a potential location of the air outlet 106 is depicted as a dotted rectangle. This particular air outlet 106 does not overlap with the air inlets 104 in either the bottom plan view (as shown) or the top plan view.

As an option applicable to any embodiment of any bed or other furniture discussed in the present description, one or more of the air inlets 104 may be elongated in a direction generally from the foot end 112 to the head end 110. As a further option, when a bed 100 comprises more than one air inlet, these air inlets 104 may be similarly shaped.

In particular, a perimeter of the inlet flow-through area of the air inlets 104 may be a concave or at least partially concave perimeter providing a concave inlet flow-through area 302. A concave area may be understood as an area that is bounded, at least in part, by an edge that is curved or angled inwards. As is visible in FIGS. 4A and 4B, the air inlets 104 have a concave area by virtue of one or more teeth 304 protruding into the air inlet 104. Accordingly, a concave perimeter, defining a concave area, may be a scalloped perimeter.

An air inlet 104 may be generally elongated and/or oriented in a direction from the head end 110 to the foot end 112 of the bed 100. The bed may for example include two air inlets 104, which may be generally identical and placed symmetrically on opposite sides of a centerline of the bed 100 in a direction parallel to the longitudinal direction of the bed 100.

Figure 5A:
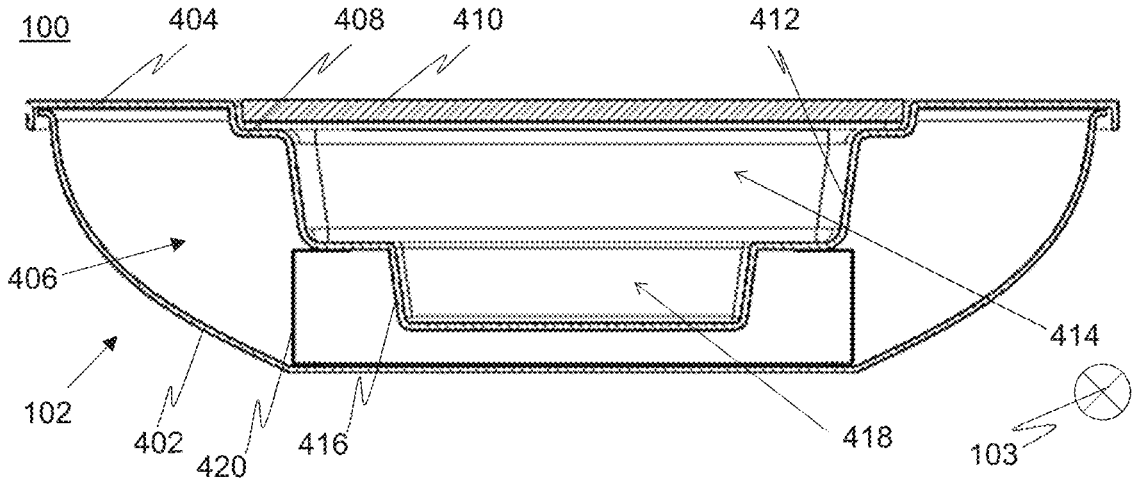
FIGS. 5A, 5B and 5C depict cross-sections of an embodiment of a representative bed.

FIG. 5A depicts a cross-section of an embodiment of a bed 100, taken generally perpendicular to the longitudinal axis 103 of the bed. In this particular embodiment, as an option readily applicable to other embodiments of the bed 100, the shell frame 102 comprises a bottom shell part 402 and a top shell part 404 between which a hollow chamber 406 is positioned (and, in some cases, defined). The top shell part 404 and the bottom shell part 402 may be connected near a top of the bed 100. As such, the bottom shell part 402 may form the bottom and the sides of the bed 100.

The top shell part 404 includes a first recessed section 408 for accommodating at least part of a slatted bed base 410. The top shell part 404 further has a second recessed section 412 forming a plenum chamber 414 for helping to distribute airflow evenly to the mattress. The top shell part 404 may further include a third recessed section 416 forming a chamber 418 for accommodating at least part of an air distribution unit 512, for example, as shown in FIG. 6B. The air outlet 106 of the shell frame with the outlet flow-through area may be provided through the third recessed section 416, as depicted in the section view of FIG. 5C.

Any recessed section of a shell part such as the top shell part 404 may comprise a generally horizontal part 440, and a substantially vertical part 441 by which the recessed section is recessed towards a bottom of the bed 100.

As an option applicable to any recessed section, a recessed section may be tapered downward towards a bottom of the bed 100. As a result, the surface area of the recessed section (when seen from above), for example the third recessed section 416, may decrease in a direction from the top of the bed 100 to the bottom of the bed 100. This may allow an air distribution unit (and or associated components) to be easily placed into the chamber 418 from above.

Figure 5B:
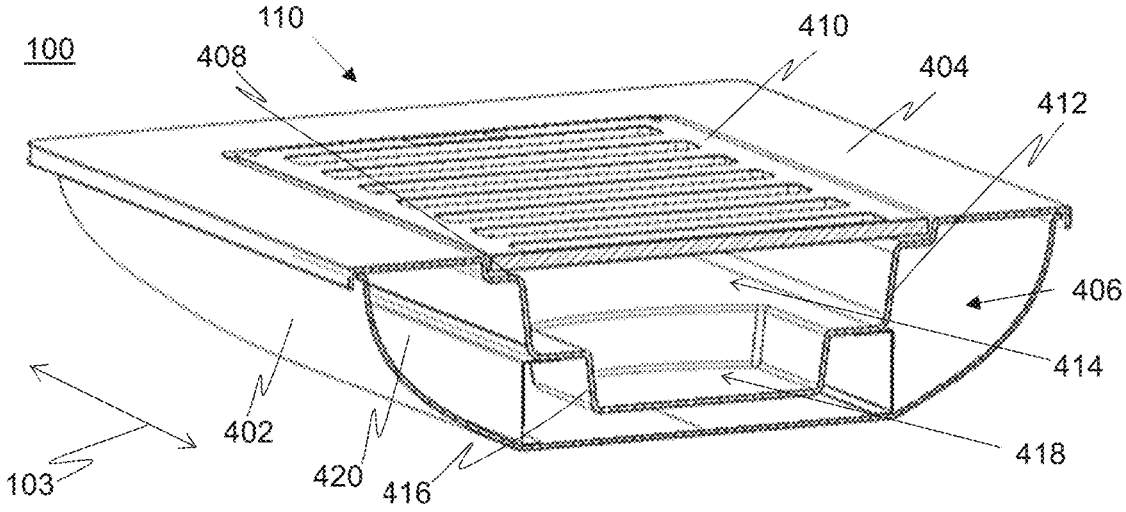
Figure 5C:
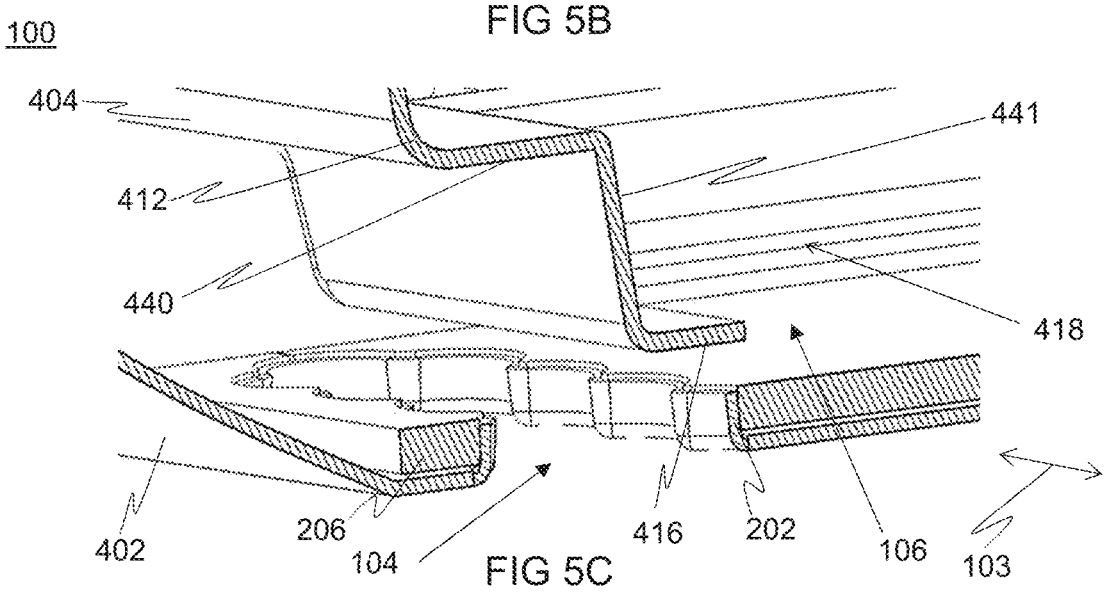

As is visible in FIGS. 5A and 5B, the second recessed section 412 may be contained within the first recessed section 408, and the third recessed section 416 may be contained within the second recessed section 412. Furthermore, the second recessed section 412 may be recessed further towards the bottom shell part 402 than the first recessed section 408, and the third recessed section 416 may be recessed further towards the bottom shell part 402 than the second recessed section 412.

The surface area in a top plan view of the third recessed section 416 may be smaller than the surface area in a top plan view of the second recessed section 412, and as a further option, the surface area in a top plan view of the second recessed section 412 may be smaller than the surface area in a top plan view of the first recessed section 408. The surface area of the outlet flow-through area of the air outlet 106 may in a top plan view be smaller than the surface area in a top plan view of the third recessed section 416.

As an option applicable to any embodiment of the bed 100, the bed 100 may comprise a support frame 420 as part of the bed frame. The support frame 420 may be connected to the shell frame 102, and as such may provide additional stiffness to the shell frame. In use, the shell frame 102, or at least part thereof may be held by the support frame a distance above a floor surface. For example, the support frame may comprise one or more legs for holding the shell frame 102 at a distance from the floor surface. This option will be elaborated on further in conjunction with FIG. 6A.

The support frame 420 may, for example, comprise a plurality of beams connected in a rectangle. The beams may for example have a cross-section at least partially of a U-shape, L-shape, C-shape, I-shape, H-shape, any other shape or any combination thereof.

Figure 6A:
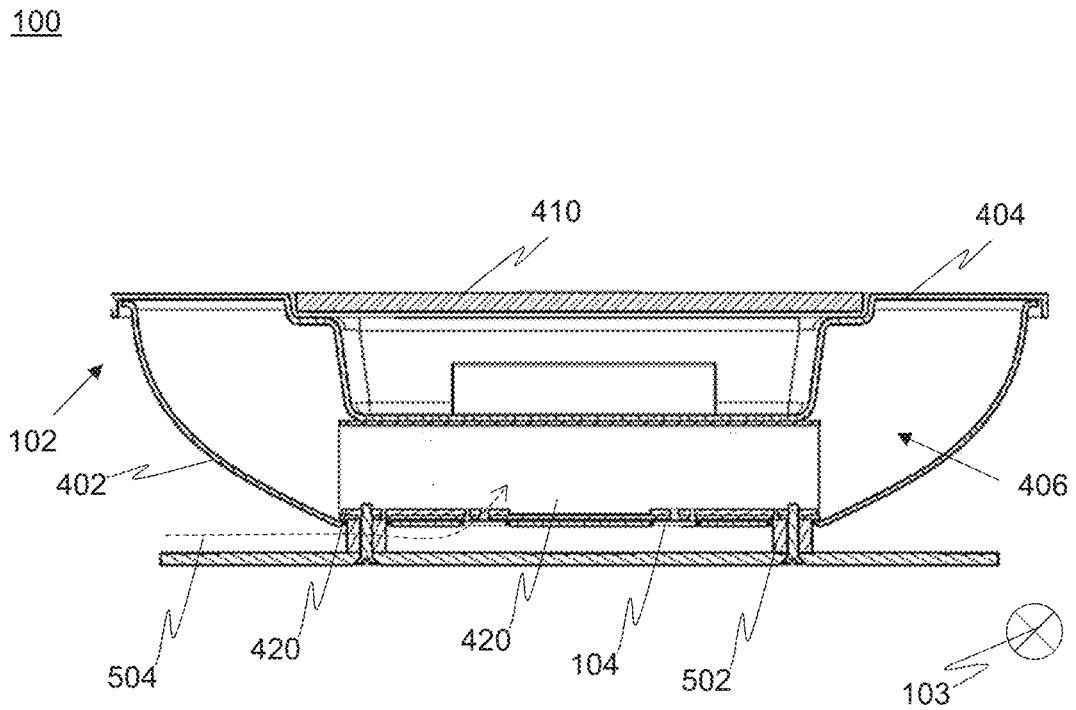
FIG. 6A depicts yet another cross-section view of an embodiment of a representative bed.
Figure 6B:
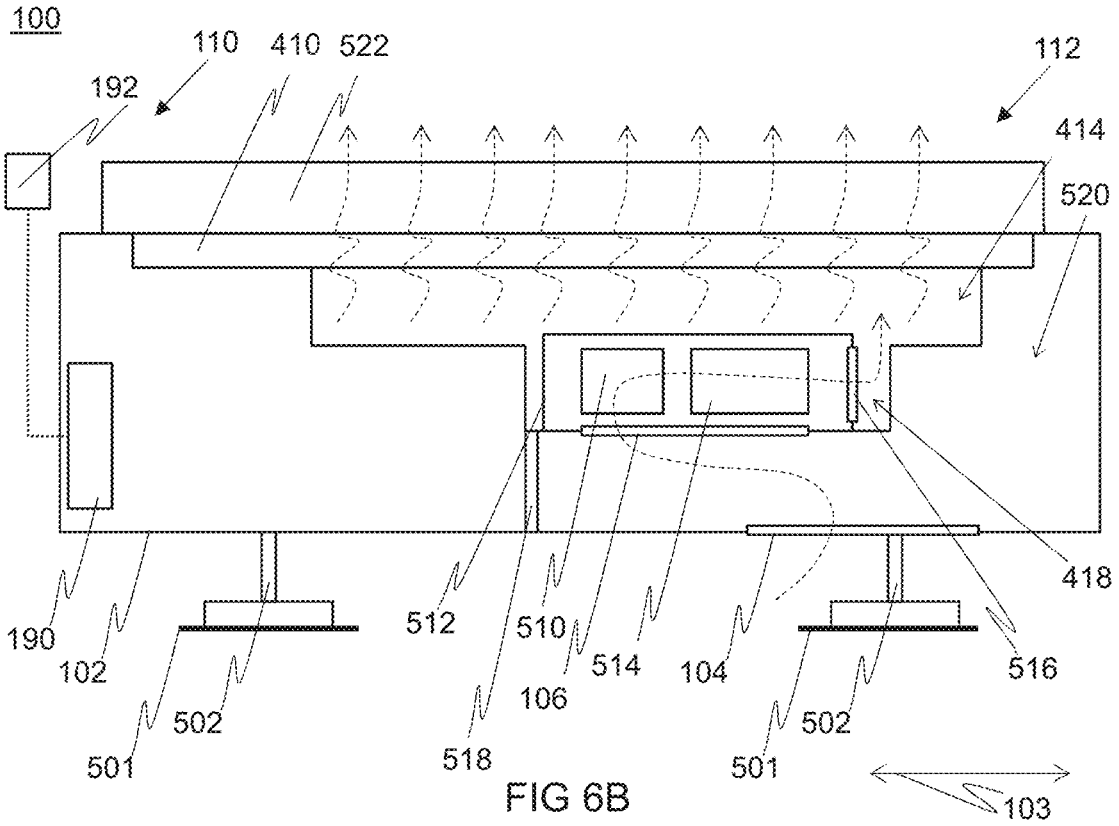
FIG. 6B depicts a schematic illustration of a representative bed.

FIG. 6A depicts yet another cross-section view of an embodiment of a bed 100, perpendicular to the longitudinal axis 103. Part of the optional support frame 420 is shown in FIG. 6A, comprising the further optional legs 502 which may protrude through the shell frame 102, in particular through the bottom shell part 402.

By virtue of the legs 502, the air inlet 104 is positioned a distance above the floor surface (not shown) on which the legs 502 stand. This allows an airflow 504 (shown as a dashed line) to pass freely underneath the bed 100 and enter into the air inlet 104. Furthermore, the air inlet 104 is placed in the bottom shell part 402, in particular in a horizontal bottom section thereof.

Positioning the air inlet 104 in the bottom of the bed 100 may restrict access to the air inlet 104. This position and/or orientation may at least discourage foreign objects from entering the air inlet 104. Such foreign objects may otherwise be sucked into the bed 100 by virtue of the air flowing into the air inlet 104. Furthermore, this arrangement can at least partially prevent a person from accidentally putting his/her hand or fingers in the air inlet 104.

Referring to FIG. 5A, the interior of the hollow chamber 406 defined by the shell frame 102, for example between a top shell part 404 and a bottom shell part 402, can include one or more separators that divide the hollow chamber 406 into two or more smaller chambers. As an option, at least part of the support frame 420 may act as a separator.

A general example of airflow through the bed 100 will be described with reference to the schematic illustration of the bed 100 in FIG. 6B. In FIG. 6B, air-flows are indicated by dashed lines ending in an arrow indicative of a typical direction of the airflow. Airflow in the opposite direction may also be used. FIG. 6B shows the bed in a schematic side view with different components inside the bed frame 102 also shown.

Air may enter the bed 100 via one or more air inlets 104, which can be provided in a bottom of the shell frame 102. When the shell frame is placed on legs 502, the air inlet(s) 104 are exposed to air surrounding the bed. The shell frame 102 may be directly supported by the legs 502 standing on a floor 501, for example a bedroom floor, or may be supported via a further structural component such as the optional support frame 420.

Air flow may be generated by a fan 510 or other suitable device. The fan 510 may be included as part of an overall air distribution unit 512. The air distribution unit 512 may include one or more air filters and an optional heating unit 514. The one or more filters and optional heating unit 514 may be positioned upstream and/or downstream of the fan 510.

The air distribution unit 512 may comprise a housing with a distribution inlet which is aligned with the air outlet 106 of the shell frame 102 or at least in fluid communication with the air outlet 106 of the shell frame 102. The housing may further include a distribution outlet 516 in fluid communication with the plenum chamber 414. Air may thus flow from the air inlet 104 to the distribution outlet 516 and then to the plenum chamber 414, via the air distribution unit 512.

As an option, the inlet flow-through area of the air inlet 104 is positioned generally parallel to the outlet flow-through area of the air outlet 106. Furthermore, the distribution outlet of the air distribution unit 512 may be orientated generally perpendicular to the outlet flow-through area of the air outlet 106.

As shown in FIG. 6B, one or more optional separator(s) 518 are positioned inside the shell frame 102, delimiting an inlet chamber 520. In particular, the inlet chamber 520 may positioned at a foot end 112 side of the bed 100. The separator 518 may prevent or reduce sound from being transported towards the head end 110 of the bed 100, where such sounds may disturb the sleeper. The separator 518 may be formed by part of the bed frame 102, such as by part of the shell frame and/or part of the support frame.

By virtue of the fan 510, a positive air pressure may be generated in the plenum chamber 414 with a pressure higher than ambient pressure, and a negative air pressure may be generated in the inlet chamber 520, which is at a pressure lower than ambient pressure.

At least part of an inner surface of the inlet chamber 520 and/or the plenum chamber 414 may be clad and/or covered with sound-absorbing material.

As depicted in FIG. 6B, and applicable to other embodiments of the bed 100, the distribution outlet 516 may be generally perpendicular to the air outlet 106 of the shell frame 102. The air outlet 106 of the shell frame 102 may be generally horizontal to the air inlet 104 of the shell frame 102, which may result in a compact bed 100 in the vertical direction.

When the pressure inside the plenum chamber 414 exceeds ambient pressure, air flows through the optional slatted bed base 410 and through an air-permeable mattress 522. As such, the air also passes to a person lying on the mattress 522. As a result of the airflow through the mattress 522, the mattress 522 can be environmentally controlled;

that is, the temperature, humidity, and/or other characteristics of the air provided by the mattress to the sleeper can be controlled.

As an option, the bed 100 and/or mattress 522 may be arranged such that the air flows through only part of the mattress 522. For example, no air may be allowed to flow through a part of the mattress 522 at or near the head end 110 of the bed 100. Because the head end of the bed is typically uncovered, while the foot end of the mattress is covered (e.g., with sheets and/or blankets), this approach can prevent the flowing air from unnecessarily leaking away.

To facilitate this arrangement, in the example of FIG. 6B, the plenum chamber 414 is smaller than the mattress 522, when viewed from above. In particular, the plenum chamber 414 does not extend under the portion of mattress 522 at the head end 110 of the bed.

Furniture, such as the bed 100 of FIG. 6B, may be provided with a control system 190, which may be configured to control different components of the furniture, for example, based on data determined by one or more sensors. When the furniture comprises an air distribution unit 512, the control system 190 may control the air distribution unit. For example, when the air distribution unit includes a fan 510, the control system 190 may be configured to control the fan 510, which in turn controls the air flow through the furniture. When the air distribution unit includes a heating unit 514, the control system 190 can be configured to control the heating unit 514, e.g., to increase the temperature of air flowing through the furniture.

One or more sensors 192 may be included in the furniture and/or provided separately from the furniture. For example, one or more sensors 192 may be positioned inside and/or on the furniture, and/or inside a room in which the furniture is placed.

A sensor 192 may be positioned to determine at least one of a temperature, humidity, air pressure, air quality such as but not limited to the presence of contaminants in the air which may be smelled by a human, flow rate, and/or any other suitable parameter relevant to the operation of the furniture. The one or more sensors 192 may be arranged to provide data to the control system 190, which in turn may be arranged to receive the data and control the furniture based on the data.

A sensor 192 may also be arranged to detect the presence of one or more persons on the furniture, for example on the mattress 522, and/or in the room in which the furniture is present. At least partially based on the detected presence (or absence of a detected presence), the control system 190 may control the air flow through the mattress 522. Since a higher air flow may typically result in more noise, the control system 190 may be arranged to reduce the air flow when one or more persons are present on the mattress 522, and increase the air flow when no persons are detected to control the temperature and/or humidity of the furniture, in particular the mattress 522, to a desired value or within a desired range.

As such, when no presence is detected, the furniture may be conditioned more thoroughly. Furthermore, the furniture may be used to environmentally control the room, for example by filtering air, and/or controlling the temperature of the air in the room.

The bed may optionally comprise one or more sensors for detecting one or more physical parameters of one or more persons on the furniture and/or in a room in which the furniture is present and for generating one or more parameter signals indicative of the detected one or more physical parameters.

Examples of physical parameters are a body temperature, heart rate, breathing parameters such respiratory rate and/or respiratory pattern, and respiratory noise such as snoring. When the furniture is arranged for accommodating multiple persons, separate parameter signals may be generated per person.

Based on the one or more parameter signals, the control system 190 may control the air flow through the mattress 522.

Figure 7:
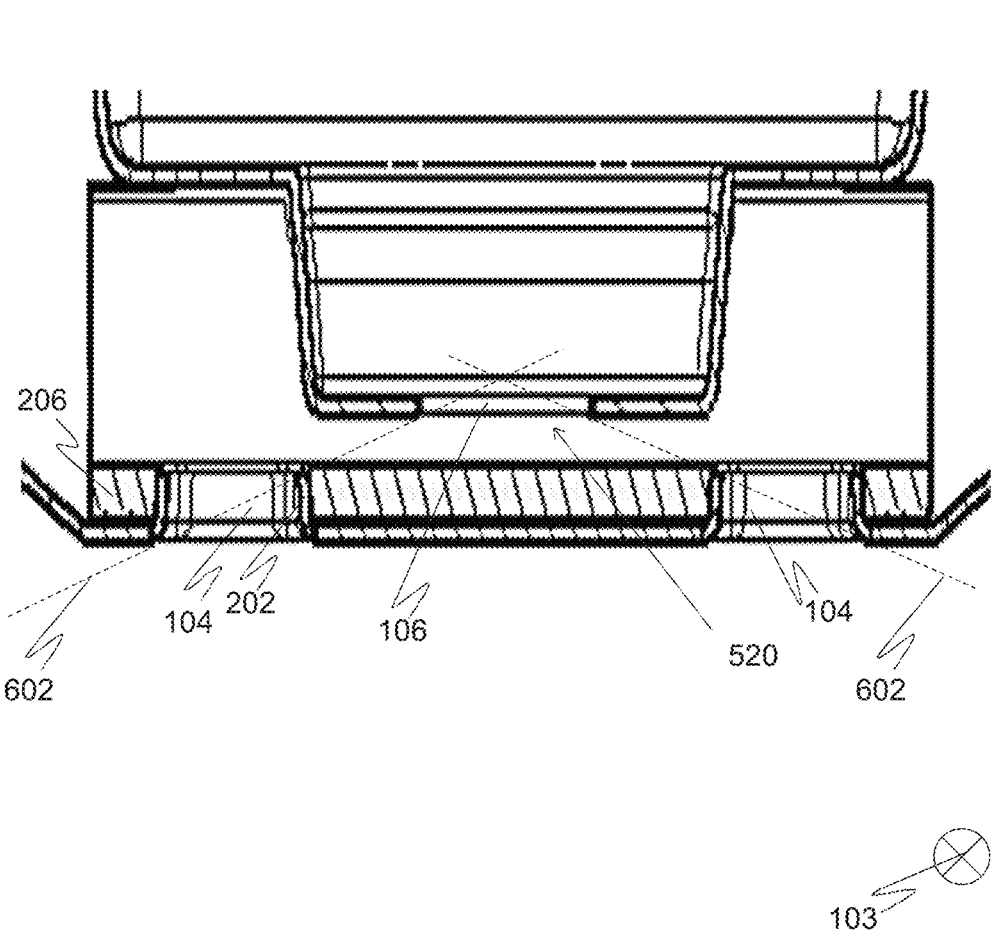
FIG. 7 shows a detailed cross-section view of part of a representative bed.

FIG. 7 shows a detailed cross-section view of part of a particular embodiment of the bed 100, wherein the inlet flow-through area is offset with respect to the outlet flow-through area such that no straight line can be drawn through the inlet flow-through area and the outlet flow-through area without this straight line intersecting an internal element of the furniture. In other words, this is no line of sight between the outlet and the inlet.

The embodiment of FIG. 7 comprises two air inlets 104, surrounded by raised walls 202 and the sound-absorbing insert 206 which clad and/or covers at least part of an inner surface of the inlet chamber 520. Two representative straight dashed lines 602 are shown in FIG. 7. The straight lines 602 are both drawn through one of the air inlets 104, in particular through the inlet flow-through area, and the air outlet 106, in particular through the outlet flow-through area. The straight lines 602 are used to show that there is no direct line of sight between the outlet and inlet.

As visible in FIG. 7, the straight lines 602 intersect the insert 206 as a part of the furniture. No straight line through the inlet flow-through area and the outlet flow-through area can be drawn in this embodiment which would not intersect part of the furniture, for example the raised wall 202 or insert 206.

As such, no straight path for sound is available between the inlet flow-through area and the outlet flow-through area. This may result in sound always encountering (or reflecting off of a) part of the furniture when travelling between the inlet flow-through area and the outlet flow-through area. When this encountered part is at least partially sound-absorbing, sound perceived by a person present on the furniture may be decreased. The encountered part may alternatively or additionally be arranged to deflect the sound towards a sound-absorbing material.

In particular embodiments, for at least 70%, at least 80%, or at least 90% of the inlet flow-through area, no straight line can be drawn through this part of the inlet flow-through area and the outlet flow-through area without the straight line intersecting the furniture.

Although in the figures, air inlets are depicted with sides which are parallel to the bed frame, in general, the air inlets may also be oriented at an angle relative to any side of the bed frame. It will also be understood that the perimeter of the air inlet may be of any shape.

In the description above, it will be understood that when an element such as layer, region or substrate is referred to as being "on" or "onto" another element, the element is either directly on the other element, or intervening elements may also be present. Also, it will be understood that the values given in the description above, are given by way of example and that other values may be possible and/or may be strived for.

Furthermore, the present technology may also include embodiments with fewer components than are described here, wherein one component carries out multiple functions. Conversely, embodiments of the present technology may include more elements than depicted in the Figures, wherein functions carried out by one component in the embodiment provided are distributed over multiple components.

It is to be noted that the figures are only schematic representations of embodiments of the technology that are given by way of non-limiting examples. For the purpose of clarity and a concise description, features are described herein as part of the same or separate embodiments, however, it will be appreciated that the scope of the invention may include embodiments having combinations of all or some of the features described.

The word 'comprising' does not exclude the presence of other features or steps than those listed in a claim. Furthermore, the words 'a' and 'an' shall not be construed as limited to 'only one', but instead are used to mean 'at least one', and do not exclude a plurality.

As used herein, the term "and/or," as in "A and/or B" refers to A alone, B alone and both A and B. As used herein, the terms "about" and "approximately" refer to values within 10% of the stated value.

A person skilled in the art will readily appreciate that various parameters and values thereof disclosed in the description may be modified and that various embodiments disclosed and/or claimed may be combined without departing from the scope of the invention.

The following examples provide additional embodiments of the present technology:

1. An environmentally conditioned piece of furniture, comprising:
   a frame positioned to support an air-permeable upholstered item, the frame comprising a shell having a hollow chamber therein, the shell including:
   at least one air inlet having an inlet total flow-through area;
   at least one air outlet having an outlet total flow-through area in fluid communication with the air inlet;
   wherein the at least one air inlet and the at least one air outlet are coupleable to an air distribution unit, and
   wherein, in a top plan view, at most 30% of the inlet total flow through area overlaps with the outlet total flow-through area
2. The furniture of example 1, wherein in the top plan view, none of the inlet total flow-through area overlaps with the outlet total flow-through area.
3. The furniture of any preceding example, wherein no straight line can be drawn through the inlet total flow-through area and the outlet total flow-through area without this straight line intersecting an internal element of the furniture.
4. The furniture of any preceding example, wherein the inlet total flow-through area is oriented generally parallel to the outlet total flow-through area.
5. The furniture of any preceding example, wherein the shell comprises a bottom section and a top section opposite the bottom section, and wherein the at least one air inlet is positioned to extend through the bottom section, and the at least one air outlet is positioned to extend through the top section.
6. The furniture of any preceding example, wherein at least part of a perimeter bounding the total flow-through area of the at least one air inlet has a concave shape.
7. The furniture of example 6, wherein the at least one air inlet comprises at least one inwardly-protruding tooth.
8. The furniture of any preceding example, wherein at least part of the at least one air inlet is surrounded by a raised wall protruding into the hollow chamber of the shell frame.
9. The furniture of any preceding example, wherein at least part of the at least one air inlet is surrounded by sound-absorbing material positioned inside the shell frame.
10. The furniture of example 9, wherein the sound-absorbing material surrounds at least part of the raised wall.
11. The furniture of example 10, wherein the sound-absorbing material surrounding the at least part of the raised wall protrudes further into the hollow chamber of the shell frame than the raised wall.
12. The furniture of any preceding example, wherein the inlet total flow-through area is larger than the outlet total flow-through area.
13. The furniture of any preceding example, further comprising a support frame with one or more legs, the support frame being positioned to support the shell at a distance from a floor surface on which the one or more legs are placed.
14. The furniture of any preceding example, further comprising the air distribution unit, wherein the air distribution unit includes an air distribution unit housing with a distribution inlet and a distribution outlet, and a fan positioned inside the air distribution unit housing to generate an air flow through the air distribution unit housing from the distribution inlet to the distribution outlet, and wherein the distribution inlet is in fluid communication with the at least one air outlet of the shell.
15. The furniture of example 14, wherein (1) the distribution inlet overlaps with the at least one air outlet of the shell frame, or (2) the distribution inlet is positioned below the at least one air outlet of the shell, or both (1) and (2).

I claim:

1. An environmentally conditioned piece of furniture, comprising:
   a frame positioned to support an air-permeable upholstered item, the frame comprising a shell, the shell including:
   a bottom section;
   a top section opposite the bottom section, the bottom section and the top section forming at least part of the shell;
   at least one air inlet provided in the bottom section, the at least one air inlet having an inlet total flow-through area; and at least one air outlet having an outlet total flow-through area in fluid communication with the at least one air inlet, wherein a portion of the at least one air outlet is vertically offset and out of vertical alignment with any portion of the at least one air inlet;
   wherein, in a top plan view, at most 30% of the inlet total flow-through area overlaps with the outlet total flow-through area;
   wherein the top section is located underneath a position on the frame upon which the air-permeable upholstered item is to be supported such that in the top plan view, the position overlaps with the top section;
   wherein the top section has a recessed section forming a plenum chamber that receives airflow through the at least one air outlet and distributes the airflow upwardly to the position from below; and wherein the at least one air outlet is positioned to extend through the top section in the recessed section.

2. The furniture of claim 1, wherein in the top plan view, none of the inlet total flow-through area overlaps with the outlet total flow-through area.

3. The furniture of claim 1, wherein no straight line can be drawn through the inlet total flow-through area and the outlet total flow-through area without the straight line intersecting an internal element of the furniture.

4. The furniture of claim 1, wherein the inlet total flow-through area is oriented generally parallel to the outlet total flow-through area.

5. The furniture of claim 1, wherein at least part of a perimeter bounding the inlet total flow-through area of the at least one air inlet has a concave shape.

6. The furniture of claim 5, wherein the at least one air inlet comprises at least one inwardly-protruding tooth.

7. The furniture of claim 1, wherein at least part of the at least one air inlet is surrounded by a raised wall protruding into the hollow chamber of the shell.

8. The furniture of claim 7, wherein at least part of the at least one air inlet is surrounded by sound-absorbing material positioned inside the shell.

9. The furniture of claim 8, wherein the sound-absorbing material surrounds at least part of the raised wall.

10. The furniture of claim 9, wherein the sound-absorbing material surrounding the at least part of the raised wall protrudes further into the hollow chamber of the shell than the raised wall.

11. The furniture of claim 1, wherein the inlet total flow-through area is larger than the outlet total flow-through area.

12. The furniture of claim 1, further comprising a support frame with one or more legs, the support frame being positioned to support the shell at a distance from a floor surface on which the one or more legs are placed.

13. The furniture of claim 1, further comprising an air distribution unit, wherein the air distribution unit includes an air distribution unit housing with a distribution inlet and a distribution outlet, and a fan positioned inside the air distribution unit housing to generate an air flow through the air distribution unit housing from the distribution inlet to the distribution outlet, and wherein the distribution inlet is in fluid communication with the at least one air outlet of the shell.

14. The furniture of claim 13, wherein (1) the distribution inlet overlaps with the at least one air outlet of the shell, or (2) the distribution inlet is positioned below the at least one air outlet of the shell, or both (1) and (2).

15. The furniture of claim 1, wherein the at least one air inlet, the at least one air outlet, and the plenum chamber are spaced apart along a direction that is perpendicular to the top plan view of the frame, and the at least one air outlet is positioned between the at least one air inlet and the plenum chamber.

16. The furniture of claim 1, wherein the plenum chamber is located within the hollow chamber of the shell.

17. The furniture of claim 1, wherein the at least one air inlet and the at least one air outlet are coupleable to an air distribution unit.

18. The furniture of claim 1, further comprising the air-permeable upholstered item.

19. The furniture of claim 1, wherein a first distance between the at least one air outlet and a floor surface on which the furniture is placed is larger than a second distance between the at least one air inlet and the floor surface.

20. The furniture of claim 1, wherein in the top plan view, at least a portion of the outlet total flow-through area does not overlap with the inlet total flow-through area.

21. The furniture of claim 1, wherein:

the at least one air outlet is at least partially offset from the at least one air outlet in both a longitudinal direction and a lateral direction of the frame such that the at most 30% of the inlet total flow-through area overlaps with the outlet total flow-through area in the top plan view.

* * * * *